US010207841B2

(12) United States Patent
Halimi

(10) Patent No.: US 10,207,841 B2
(45) Date of Patent: Feb. 19, 2019

(54) SECURE FOOD TRANSPORT BAGS

(71) Applicant: Albert Halimi, Vernon, CA (US)

(72) Inventor: Albert Halimi, Vernon, CA (US)

(73) Assignee: GRAND PACKAGING, INC., Vernon, CA (US)

( * ) Notice: Subject to any disclaimer, the term of this patent is extended or adjusted under 35 U.S.C. 154(b) by 0 days.

(21) Appl. No.: 15/793,230

(22) Filed: Oct. 25, 2017

(65) Prior Publication Data

US 2019/0016506 A1 Jan. 17, 2019

Related U.S. Application Data

(63) Continuation of application No. PCT/US2017/041781, filed on Jul. 12, 2017.

(51) Int. Cl.

| | |
|---|---|
| ***B65D 33/24*** | (2006.01) |
| ***B65D 33/01*** | (2006.01) |
| ***B65D 33/10*** | (2006.01) |
| ***B65D 33/16*** | (2006.01) |

(52) U.S. Cl.

CPC ..... *B65D 33/24* (2013.01); *B65D 33/01* (2013.01); *B65D 33/105* (2013.01); *B65D 33/1691* (2013.01)

(58) Field of Classification Search

CPC ..... B65D 33/24; B65D 33/01; B65D 33/105; B65D 33/331691

USPC .... 383/78, 5, 25, 28, 30, 31, 93, 95, 98, 99, 383/6, 7

See application file for complete search history.

(56) References Cited

U.S. PATENT DOCUMENTS

| | | | | |
|---|---|---|---|---|
| 1,792,885 A | | 2/1931 | Andrews | |
| 2,339,304 A | | 1/1944 | Von Haase | |
| 2,516,266 A | | 7/1950 | Simpson | |
| 3,017,070 A | * | 1/1962 | London | B65D 33/14 383/22 |

(Continued)

FOREIGN PATENT DOCUMENTS

| | | | | |
|---|---|---|---|---|
| FR | 2699505 A1 | * | 6/1994 | B65D 33/18 |
| GB | 846770 A | * | 8/1960 | B65D 27/22 |

(Continued)

OTHER PUBLICATIONS

International Search Report and Written Opinion dated Sep. 13, 2017 for PCT Application No. PCT/US17/041781.

*Primary Examiner* — Jes F Pascua

(74) *Attorney, Agent, or Firm* — David A. Belasco; Belasco Jacobs & Townsley, LLP

(57) ABSTRACT

A first embodiment of a secure food transport bag has front and rear walls. An upper portion of the front wall has an attached tamper-proof compound affixed to its interior surface. To seal the bag, a protective strip is removed from the compound and the upper portion is pivoted upwardly and pressed to an interior surface of the back wall of the bag. A folded strip handle is attached to the back wall and sealed between the front and back walls. A second embodiment of the bag has a tamper-proof adhesive compound affixed to an interior portion of the back wall and covered with a protective strip. A folded portion of the front wall is sealed to the front wall at side edges and two center seals adjacent the center of the bag. These center seals form a handle opening when the back wall is sealed to the folded portion.

12 Claims, 6 Drawing Sheets

(56) References Cited

U.S. PATENT DOCUMENTS

| | | | | | |
|---|---|---|---|---|---|
| 3,688,973 | A | | 9/1972 | Lillkvist | |
| 3,811,613 | A | * | 5/1974 | Harrison | B65D 33/12 383/20 |
| 3,858,789 | A | | 1/1975 | Verbeke | |
| 4,483,445 | A | | 11/1984 | Lepisto et al. | |
| 5,356,221 | A | * | 10/1994 | Achelpohl | B65D 33/105 383/21 |
| 6,146,016 | A | | 11/2000 | Mucci | |
| 7,427,161 | B2 | | 9/2008 | Sill et al. | |
| 2003/0235348 | A1 | * | 12/2003 | Pape | B65D 33/065 383/7 |
| 2005/0047686 | A1 | | 3/2005 | Elsaesser | |
| 2018/0162600 | A1 | * | 6/2018 | Tan | B65D 33/01 |
| 2018/0162603 | A1 | * | 6/2018 | Tan | B65D 33/34 |

FOREIGN PATENT DOCUMENTS

| | | | | | |
|---|---|---|---|---|---|
| JP | 05084108 | A | * | 4/1993 | B32B 70/00 |
| JP | 2005329993 | A | * | 12/2005 | |
| WO | 2004071890 | | | 8/2004 | |

* cited by examiner

SECURE FOOD TRANSPORT BAGS

RELATED APPLICATION

The instant application is a continuation of International Application No. PCT/US2017/041781, filed Jul. 12, 2017 and incorporates the disclosure of which in its entirety.

FIELD OF INVENTION

This invention relates to the field of plastic and other film bags and more specifically to food transport bags with tamper proof sealing systems.

BACKGROUND OF THE INVENTION

Many restaurants, fast food chains and other providers of ready-to-eat meal service are now offering home delivery service for their products. Increasing numbers of such providers are contracting their delivery service to persons not directly in their employ. As a result, the food providers are becoming increasingly concerned that their food products may become contaminated in the course of delivery by persons or circumstances beyond their control. Both food providers and their customers now seek means to insure that the food delivered is wholesome and safe to eat. In order to address this issue, the present invention describes secure food transport bags that provide definitive evidence of whether or not the bag has been opened prior to delivery of the food product.

Heated food products provide an additional challenge as excessive heat can affect the taste, texture and desirability of the food. For these reasons, a secure food transport bag must also provide effective venting. Some examples of tamper-proof food transport systems and related inventions include the following.

PCT Application No. PCT/CH2003/000112, published for Elsaesser, discloses a packaging sack having a closure and handle. A removable backing is peeled off of an adhesive layer at the flap portion. The flap portion is folded over the opening of bag. A handle extends from flap portion and is rotated with the flap portion when the flap portion is folded over the opening of bag.

U.S. Pat. No. 1,792,885, issued to Andrews is directed to a carrier bag. This device is an envelope with handle attachments. The handle attachment is secured to a flap. The handle attachment is fixed to the side of the envelope opposite the flap. When the flap is folded along crease, the handle attachment is reoriented to align with opposite handle attachment and forms a handle after the envelope is closed.

U.S. Pat. No. 2,516,266, issued to Simpson illustrates a parcel bag. This bag includes a flap for folding over a handle member and the bag mouth between walls. With the bag closed, a locking tongue engages the handle member through finger opening.

U.S. Pat. No. 7,427,161, issued to Sill et al. is directed to a plastic bag with a unitary handle and closure member. This plastic bag includes a body portion and a unitary handle and closure member secured to the body portion. The closure member has a handle portion and a closure portion. The closure portion is folded over the opening of body portion and fixed to the opposite side to seal the plastic bag. The closure portion does not appear to seal the entire opening and in addition to this lack of sealing the entire opening, the plastic bag includes vent openings.

U.S. Patent Application No. 2005/0047686, issued to Elsaesser is directed to a resealable packaging bag. This bag includes a back side and a front side, and its lateral portions preferably have side gussets. Formed at the lower end of the bag is a floor and at the upper end there is an opening, through which the bag is filled or emptied. A backing is permanently fixed on the back side near the opening edge of the bag and projecting beyond it. The backing is divided by a separation line into two parts, the separation line being aligned exactly with the bag edge. Adhered to the backing is a section made out of a flexible material provided with a self-adhesive layer/label. The backing is provided on its side turned toward the label with a coating enabling the separation of the label. When the bag is to be closed, the portion of the backing projecting beyond the bag edge is pulled off, which is facilitated by the separation line. The part of the label protruding over the bag edge is bent over and the self-adhesive layer of the label which has become exposed through the pulling off of the portion of the backing is stuck onto the front side of the bag.

U.S. Pat. No. 4,483,445, issued to Lepisto et al. discloses a bag with an easy opening closure and handle. When closed, the bag may be either adhesively tacked of stapled at spaced locations, to the back panel to form a finger grip handle for carrying the bag and its contents.

U.S. Pat. No. 6,146,016, issued to Mucci et al. discloses a handle closure system. This system provides a reinforced handle with a notch. The notch is provided for placement of the fingers when the handle closure system is grabbed to carry the bag.

U.S. Pat. No. 2,339,304, issued to Von Haase is directed to a sealed bag and process for making same. The bag is sealed using pressure and heat with the sealed end having a pocket. When the bag is sealed, a separating device is used to interfere with the sealing process along the central portion of the seal. This interference creates the pocket which is to be used for hanging the bag on a hook.

U.S. Pat. No. 3,858,789, issued to Verbeke is directed to a plastic bag. This plastic bag has a handle formed as a pocket when a flap is heat sealed. The pocket is formed between two heat seals. An additional seal is made at a point below the formation of pocket to seal the bag entirely.

U.S. Pat. No. 3,688,973, issued to Lillkvist is directed to a carrying and closing device for bags and sacks. The bag includes a strip with a metal wire retained within the strip. The bag is folded down over the strip and then folded again together with the strip. This creates a handle with length sufficient to allow it to be grasped with two hands.

It is an objective of the present invention to provide secure food transport bags that provide positive evidence as to whether the bag has been opened after its initial sealing after filling with a food product. It is a further objective to provide sanitary, one-use disposable bags with tamper-evident seals. It is a still further objective of the invention to provide secure food transport bags with sufficient venting to accommodate hot food products. It is yet a further objective to provide such bags with comfortable, easy to use carrying handles. Finally, it is an objective of the present invention to provide tamper evident bags that are strong, secure and inexpensive to manufacture and simple to use.

While some of the objectives of the present invention are disclosed in the prior art, none of the inventions found include all of the requirements identified.

SUMMARY OF THE INVENTION

The present invention addresses all of the deficiencies of prior art secure food transport bags and satisfies all of the objectives described above.

(1) A secure food transport bag providing all of the desired features can be constructed from the following components. A front wall and a back wall are provided. The front and back walls are formed of flexible film material and have top and bottom edges and first and second side edges. The front and back walls are joined together along their first and second side edges at first and second side seams and along their bottom edges at a bottom seam to form a bag with an open mouth.

The first and second side seams have first and second cuts. The first and second cuts are located adjacent upper ends of the first and second side seams and extend from the top edges downwardly toward the bottom edges for a first predetermined distance. The front wall has a fold. The fold is parallel to the top edge of the front wall and is located at a point spaced downwardly from the top edge. The fold defines an interior surface portion of the front wall and locates the interior surface portion in a coplanar position with an exterior surface of the front wall.

A tamper-proof adhesive compound is provided. The compound is affixed to the interior surface portion of the front wall and extends from the first side edge to the second side edge. The tamper-proof adhesive compound is removable from the flexible film material only with force sufficient to tear the material. A removable protective strip is provided. The protective strip is adhered to the tamper-proof adhesive compound to prevent its attachment to the flexible film material until closing of the bag. After placing a food item into the bag, the protective strip is removed from the interior surface portion of the front wall and the interior surface portion is folded upwardly and pressed to an interior portion of the back wall adjacent the top edge of the back wall, thereby sealing the bag with the food item inside with a tamper-proof seal.

(2) In a variant of the invention, a film handle is provided. The handle is formed from flexible film material and sealed to the interior portion of the back wall adjacent the top edge of the back wall. When the interior surface portion of the front wall is sealed to the interior portion of the back wall, the film handle is partially sealed between the front wall and the back wall.

(3) In another variant, at least one vent opening is provided. The vent opening is formed as a notch in the front wall and the back wall. The notch extends downwardly from the top edges and inwardly from either of the first and second side edges.

(4) In still another variant, a bottom gusset is provided. The bottom gusset is folded inwardly from the bottom seam and sealed to the first and second side edges in the first and second side seams.

(5) In yet another variant, the tamper-proof adhesive compound is a pressure sensitive adhesive comprising 0%-100% rosin ester and an elastomer selected from the group comprising acrylics, bio-based acrylate, butyl rubber, ethylene-vinyl acetate, natural rubber, nitriles, and silicone rubbers.

(6) In a further variant, the flexible film material includes 25% to 75% high density high molecular weight polyethylene resin, 20% to 75% linear low polyethylene resin, 0% to 20% low density polyethylene, 0% to 10% color concentrate, 0% to 15% calcium fillers, 0% to 20% post-consumer resin and 0% to 4% other additives.

(7) In still a further variant, the flexible film material includes 0%-100% corn-based products.

(8) In yet a further variant of the invention, a secure food transport bag includes a front wall and a back wall. The front and back walls are formed of flexible film material and have top and bottom edges and first and second side edges. The front wall has a folded portion. The folded portion has an upper edge. The upper edge is parallel to the top edge. The folded portion extends downwardly from the top edge for a first predetermined distance. The front and back walls are joined together along their first and second side edges at first and second side seams. The first and second side seams secure first and second distal ends of the folded portion to an outer surface of the front wall. The front and back walls are joined together along their bottom edges at a bottom seam to form a bag with an open mouth.

The folded portion is sealed to the outer surface of the front wall with first and second vertical seals. The first and second vertical seals are spaced from a center point of the folded portion to form a handle opening. A tamper-proof adhesive compound is provided. The compound is affixed to an interior surface portion of the back wall adjacent the top edge and extends from the first side edge to the second side edge. The tamper-proof adhesive is removable from the flexible film material only with force sufficient to tear the material.

A removable protective strip is provided. The protective strip is adhered to the tamper-proof adhesive to prevent its attachment to the flexible film material until closing of the bag. After placing a food item into the bag, the protective strip is removed from the interior surface portion of the back wall and the interior surface portion is folded downwardly and pressed to an outer surface of the folded portion of the front wall, thereby sealing the bag with the food item inside with a tamper-proof seal.

(9) In another variant of the invention, first and second angled seals are provided. The first and second angled seals extend from the first and second vertical seals upwardly at an angle toward the upper edge of the folded portion, thereby forming a contoured shape for the handle opening.

(10) In still another variant, a bottom gusset is provided. The bottom gusset is folded inwardly from the bottom seam and sealed to the first and second side edges in the first and second side seams.

(11) In yet another variant, the tamper-proof adhesive compound is a pressure sensitive adhesive comprising 0%-100% rosin ester and an elastomer selected from the group comprising acrylics, bio-based acrylate, butyl rubber, ethylene-vinyl acetate, natural rubber, nitriles, and silicone rubbers.

(12) In another variant of the invention, the flexible film material includes 25% to 75% high density high molecular weight polyethylene resin, 20% to 75% linear low polyethylene resin, 0% to 20% low density polyethylene, 0% to 10% color concentrate, 0% to 15% calcium fillers, 0% to 20% post-consumer resin and 0% to 4% other additives.

(13) In a final variant, the flexible film material comprises 0%-100% corn based products.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-5 illustrate a secure food transport bag 10 providing all of the desired features that can be constructed from the following components. A front wall 14 and a back wall 18 are provided. The front 14 and back 18 walls are formed of flexible film material 22 and have top 26 and bottom 30 edges and first 34 and second 38 side edges. The front 14 and back 18 walls are joined together along their first 34 and second 38 side edges at first 42 and second 46 side seams and along their bottom edges 30 at a bottom seam 50 to form a bag 10 with an open mouth 54.

Figure 1:
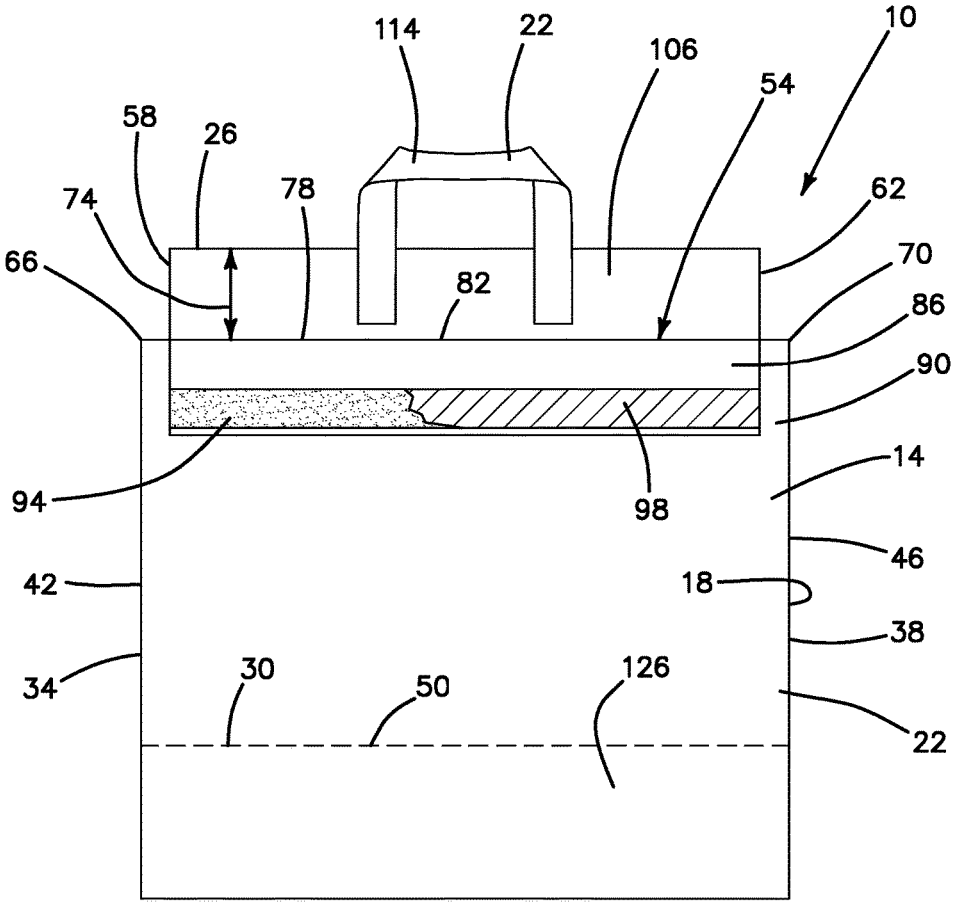
FIG. 1 is a front view of a first embodiment of the invention illustrating the tamper-proof adhesive compound and protective strip attached to interior surface portion of the front wall of the bag.
Figure 2:
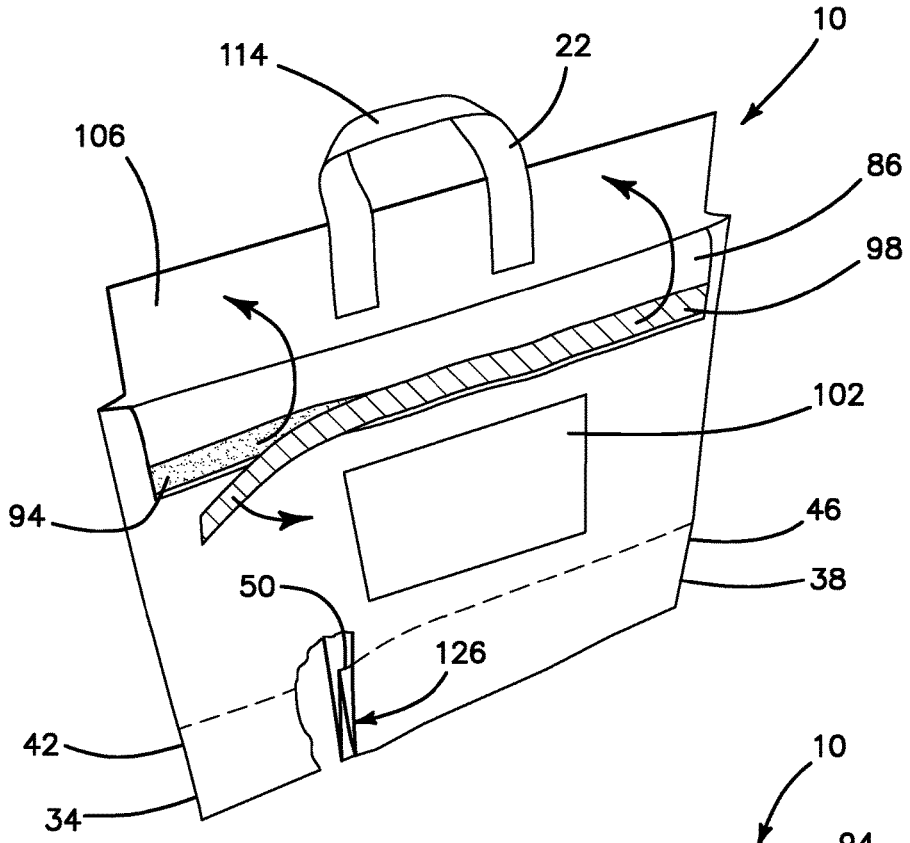
FIG. 2 is a perspective view of the FIG. 1 embodiment illustrating closure of the bag and a cutaway view of a bottom gusset.
Figure 4:
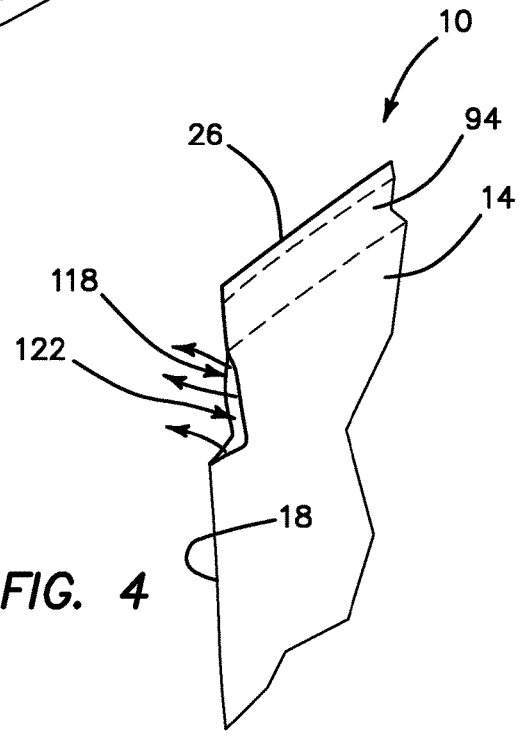
FIG. 4 is a partial perspective view of the FIG. 1 embodiment illustrating the vent located at the upper corner of the bag.
Figure 3:
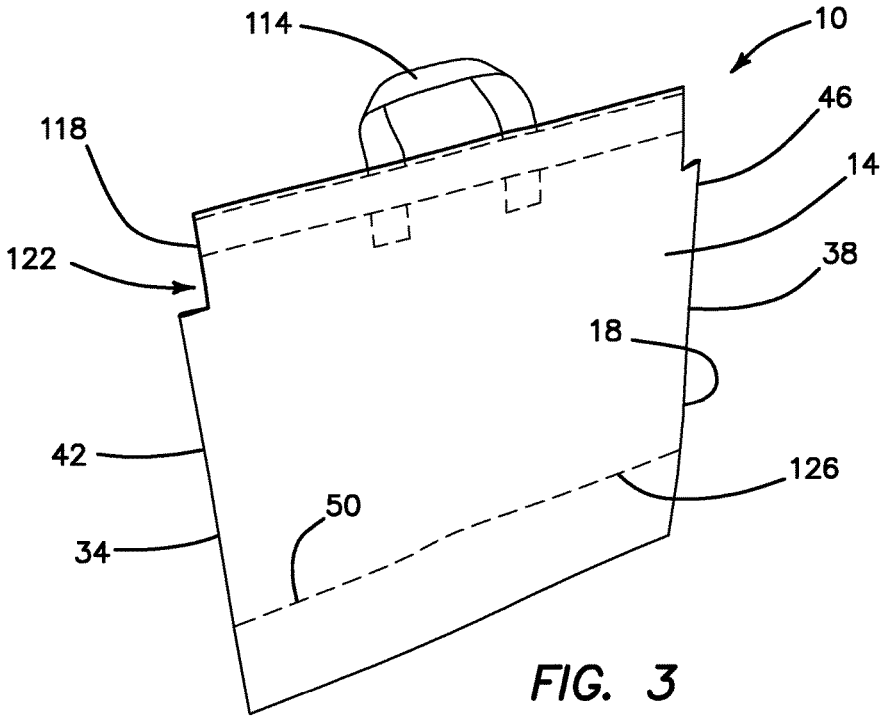
FIG. 3 is a perspective view of the FIG. 1 embodiment in fully closed condition.
Figure 5:
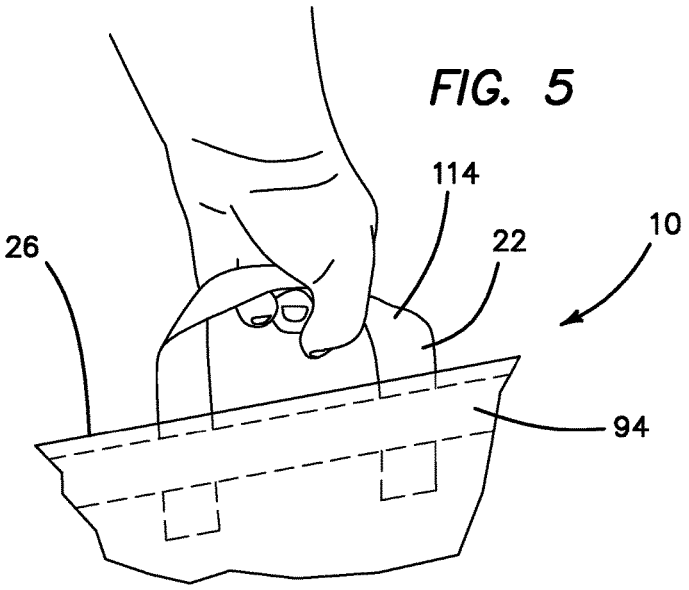
FIG. 5 is a partial perspective view of the FIG. 1 embodiment illustrating the bag handle and its attachment to the bag.
Figure 6:
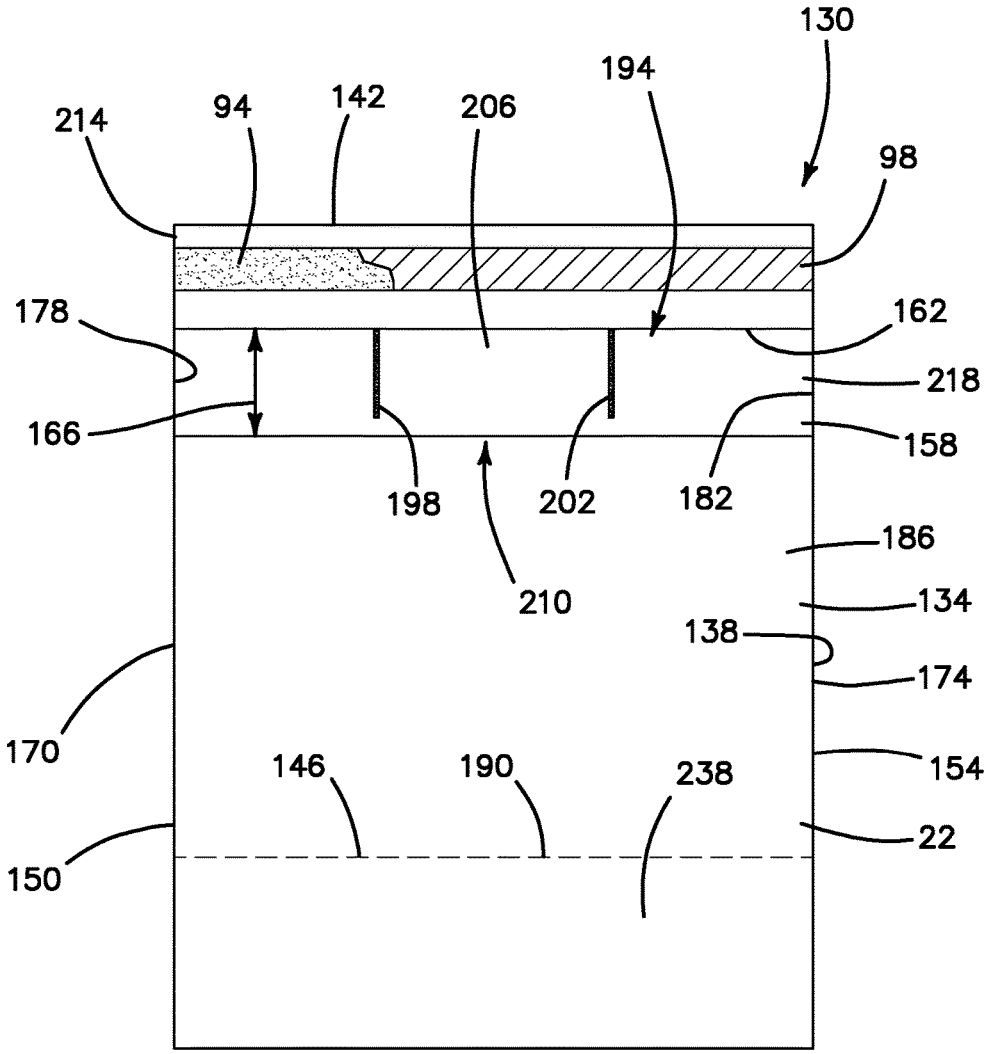
FIG. 6 is a front view of a second embodiment of the bag illustrating the tamper-proof adhesive compound, protective strip and handle opening seals.

The first 42 and second 46 side seams have first 58 and second 62 cuts. The first 58 and second 62 cuts are located adjacent upper ends 66, 70 of the first 42 and second 46 side seams and extend from the top edges 26 downwardly toward the bottom edges 30 for a first predetermined distance 74. The front wall 14 has a fold 78. The fold 78 is parallel to the top edge 26 of the front wall 14 and is located at a point 82 spaced downwardly from the top edge 26. The fold 78 defines an interior surface portion 86 of the front wall 14 and locates the interior surface portion 86 in a coplanar position with an exterior surface 90 of the front wall 14.

A tamper-proof adhesive compound 94 is provided. The compound 94 is affixed to the interior surface portion 86 of the front wall 14 and extends from the first side edge 34 to the second side edge 38. The tamper-proof adhesive compound 94 is removable from the flexible film material 22 only with force sufficient to tear the material 22. A removable protective strip 98 is provided. The protective strip 98 is adhered to the tamper-proof adhesive compound 94 to prevent its attachment to the flexible film material 22 until closing of the bag 10. After placing a food item 102 into the bag 10, the protective strip 98 is removed from the interior surface portion 86 of the front wall 14 and the interior surface portion 86 is folded upwardly and pressed to an interior portion 106 of the back wall 18 adjacent the top edge 26 of the back wall 18, thereby sealing the bag 10 with the food item 102 inside with a tamper-proof seal 110.

(2) In a variant of the invention, a film handle 114 is provided. The handle 114 is formed from flexible film material 22 and sealed to the interior portion 106 of the back wall 18 adjacent the top edge 26 of the back wall 18. When the interior surface portion 86 of the front wall 14 is sealed to the interior portion 106 of the back wall 18, the film handle 114 is partially sealed between the front wall 14 and the back wall 18.

(3) In another variant, at least one vent opening 118 is provided. The vent opening 118 is formed as a notch 122 in the front wall 14 and the back wall 18. The notch 122 extends downwardly from the top edges 26 and inwardly from either of the first 34 and second 38 side edges.

(4) In still another variant, a bottom gusset 126 is provided. The bottom gusset 126 is folded inwardly from the bottom seam 50 and sealed to the first 34 and second 38 side edges in the first 42 and second 46 side seams.

(5) In yet another variant, the tamper-proof adhesive compound 94 is a pressure sensitive adhesive comprising 0%-100% rosin ester and an elastomer selected from the group comprising acrylics, bio-based acrylate, butyl rubber, ethylene-vinyl acetate, natural rubber, nitriles, and silicone rubbers.

(6) In a further variant, the flexible film material 22, includes 25% to 75% high density high molecular weight polyethylene resin, 20% to 75% linear low polyethylene resin, 0% to 20% low density polyethylene, 0% to 10% color concentrate, 0% to 15% calcium fillers, 0% to 20% post-consumer resin and 0% to 4% other additives.

(7) In still a further variant, the flexible film material 22, includes 0%-100% corn-based products.

(8) In yet a further variant of the invention, as illustrated in FIGS. 6-10, a secure food transport bag 130 includes a front wall 134 and a back wall 138. The front 134 and back 138 walls are formed of flexible film material 22 and have top 142 and bottom 146 edges and first 150 and second 154 side edges. The front wall 134 has a folded portion 158. The folded portion 158 has an upper edge 162. The upper edge 162 is parallel to the top edge 142. The folded portion 158 extends downwardly from the top edge 142 for a first predetermined distance 166. The front 134 and back 138 walls are joined together along their first 150 and second 154 side edges at first 170 and second 174 side seams. The first 170 and second 174 side seams secure first 178 and second 182 distal ends of the folded portion 158 to an outer surface 186 of the front wall 134. The front 134 and back 138 walls are joined together along their bottom edges 146 at a bottom seam 190 to form a bag 130 with an open mouth 194.

The folded portion 158 is sealed to the outer surface 186 of the front wall 134 with first 198 and second 202 vertical seals. The first 198 and second 202 vertical seals are spaced from a center point 206 of the folded portion 158 to form a handle opening 210. A tamper-proof adhesive compound 94 is provided. The compound 94 is affixed to an interior surface portion 214 of the back wall 138 adjacent the top edge 142 and extends from the first side edge 150 to the second side edge 154. The tamper-proof adhesive 94 is removable from the flexible film material 22 only with force sufficient to tear the material 22.

A removable protective strip 98 is provided. The protective strip 98 is adhered to the tamper-proof adhesive 94 to prevent its attachment to the flexible film material 22 until closing of the bag 130. After placing a food item 102 into the bag 130, the protective strip 98 is removed from the interior surface portion 214 of the back wall 138 and the interior surface portion 214 is folded downwardly and pressed to an outer surface 218 of the folded portion 158 of the front wall 134, thereby sealing the bag 130 with the food item 102 inside with a tamper-proof seal 222.

Figure 7:
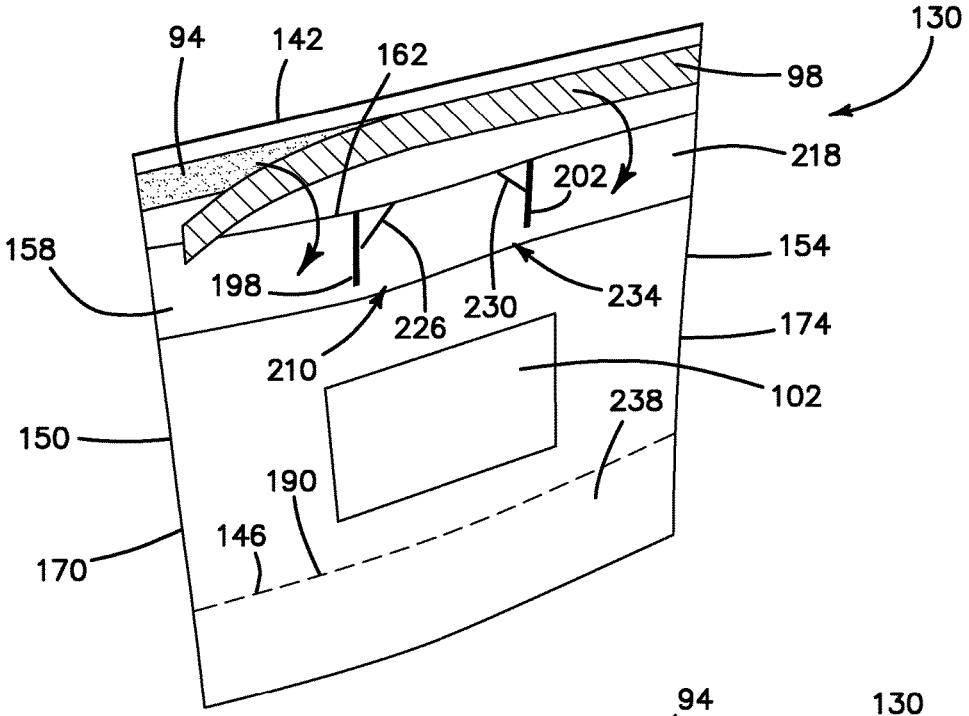
FIG. 7 is a perspective view of the FIG. 6 embodiment illustrating closure of the bag.
Figure 8:
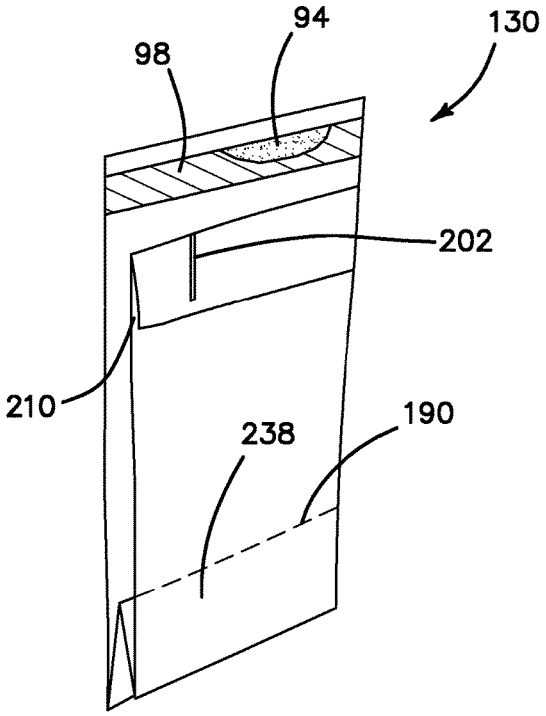
FIG. 8 is a perspective cross-sectional view of the FIG. 6 embodiment illustrating a bottom bag gusset.
Figure 9:
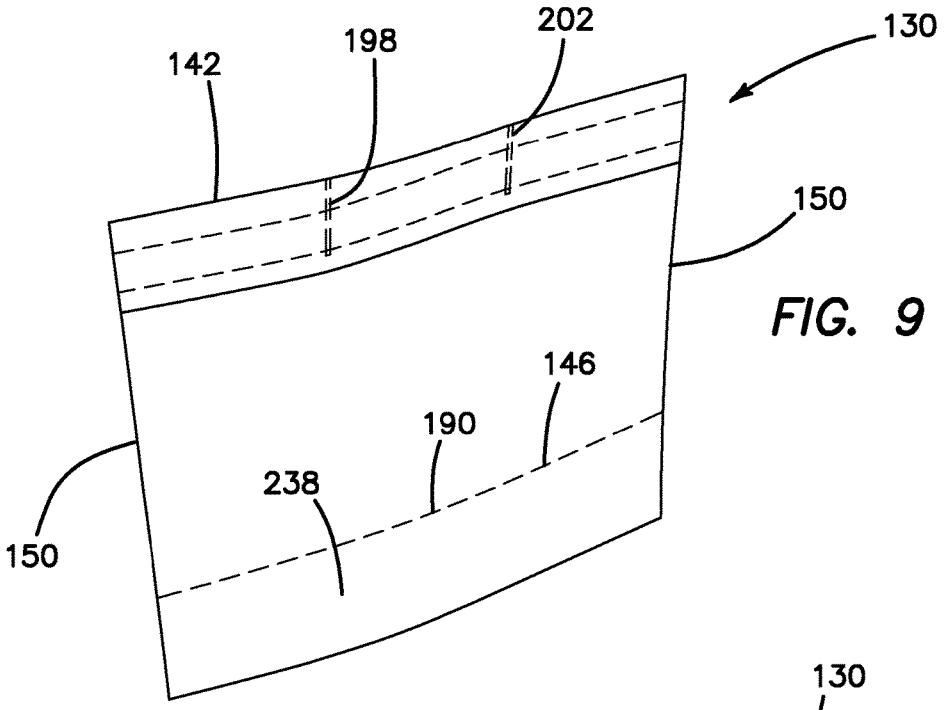
FIG. 9 is a perspective view of the FIG. 6 embodiment in fully closed condition.
Figure 10:
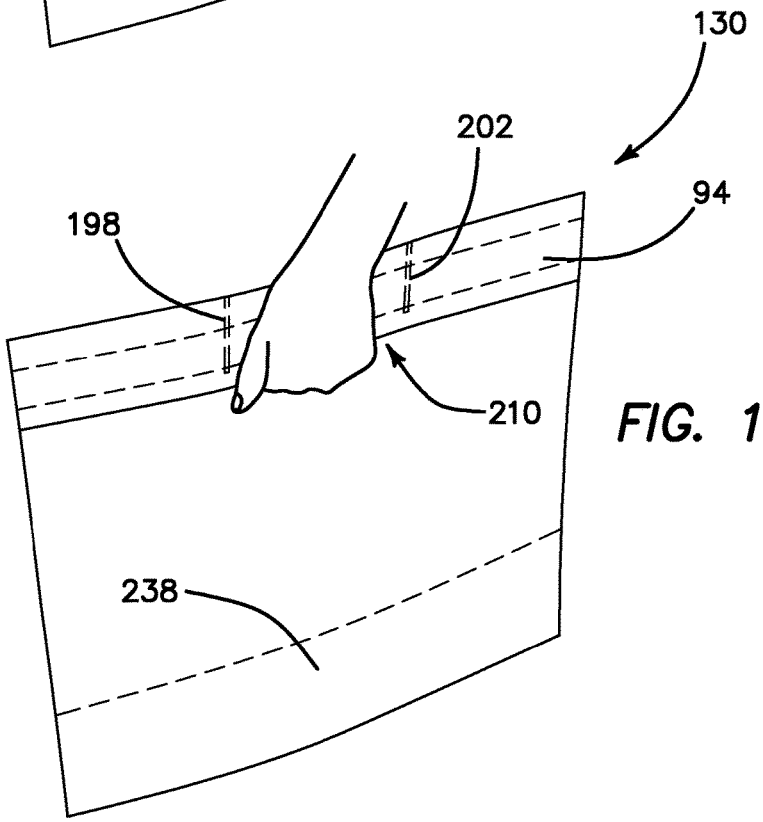
FIG. 10 is a perspective view of the FIG. 6 embodiment illustrating use of the handle opening.

(9) In another variant of the invention, first 226 and second 230 angled seals are provided. The first 226 and second 230 angled seals extend from the first 198 and second 202 vertical seals upwardly at an angle toward the upper edge 162 of the folded portion 158, thereby forming a contoured shape 234 for the handle opening 210, as illustrated in FIG. 7.

(10) In still another variant, as illustrated in FIGS. 6-10, a bottom gusset 238 is provided. The bottom gusset 238 is folded inwardly from the bottom seam 190 and sealed to the first 150 and second 154 side edges in the first 170 and second 174 side seams.

(11) In yet another variant, the tamper-proof adhesive compound 94 is a pressure sensitive adhesive comprising 0%-100% rosin ester and an elastomer selected from the group comprising acrylics, bio-based acrylate, butyl rubber, ethylene-vinyl acetate, natural rubber, nitriles, and silicone rubbers.

(12) In a further variant of the invention, the flexible film material 22 includes 25% to 75% high density high molecular weight polyethylene resin, 20% to 75% linear low polyethylene resin, 0% to 20% low density polyethylene, 0% to 10% color concentrate, 0% to 15% calcium fillers, 0% to 20% post-consumer resin and 0% to 4% other additives.

(13) In a final variant, the flexible film material includes 0%-100% corn-based products.

The secure food transport bags 10 and 130 have been described with reference to particular embodiments. Other modifications and enhancements can be made without departing from the spirit and scope of the claims that follow.

The invention claimed is:

1. A secure food transport bag comprising:

a front wall and a back wall, said front and back walls being formed of flexible film material and having top and bottom edges and first and second side edges;

said front and back walls being joined together along their first and second side edges at first and second side seams and along their bottom edges at a bottom seam to form a bag with an open mouth;

said first and second side seams having first and second cuts, said first and second cuts being disposed adjacent upper ends of said first and second side seams and extending from said top edges downwardly toward said bottom edges for a first predetermined distance;

said front wall having a fold, said fold being parallel to said top edge of said front wall and being disposed at a point spaced downwardly from said top edge;

said fold defining an interior surface portion of said front wall and disposing said interior surface portion in a coplanar position with an exterior surface of said front wall;

a tamper-proof adhesive compound, said compound being affixed to said interior surface portion of said front wall and extending from said first side edge to said second side edge;

said tamper-proof adhesive compound being removable from said flexible film material only with force sufficient to tear said material;

a removable protective strip, said protective strip being adhered to said tamper-proof adhesive compound to prevent its attachment to said flexible film material until closing of said bag;

a separate film handle, said handle being formed from a flat strip of flexible film material formed into a handle loop and sealed at its distal ends to said interior portion of said back wall adjacent said top edge of said back wall, a central portion of said handle loop extending above said top edges of said front wall and said back wall;

wherein, when said interior surface portion of said front wall is sealed to said interior portion of said back wall, said distal ends of said film handle loop will be sealed between said front wall and said back wall; and wherein after placing a food item into said bag, said protective strip is removed from said interior surface portion of said front wall and said interior surface portion is folded upwardly and pressed to an interior portion of said back wall adjacent said top edge of said back wall, thereby sealing the bag with the food item inside with a tamper-proof seal.

2. The secure food transport bag, as described in claim 1, further comprising at least one rectangular vent opening, said rectangular vent opening formed as a notch in said front wall and said back wall, said notch extending downwardly from said top edges and inwardly from either of said first and second side edges.

3. The secure food transport bag, as described in claim 1, further comprising a bottom gusset, said bottom gusset being folded inwardly from said bottom seam and sealed to said first and second side edges in said first and second side seams.

4. The secure food transport bag, as described in claim 1, wherein said tamper-proof adhesive compound is a pressure sensitive adhesive comprising 0%-100% rosin ester and an elastomer selected from the group comprising acrylics, bio-based acrylate, butyl rubber, ethylene-vinyl acetate, natural rubber, nitriles, and silicone rubbers.

5. The secure food transport bag, as described in claim 1, wherein said flexible film material comprises 25% to 75% high density high molecular weight polyethylene resin, 20% to 75% linear low polyethylene resin, 0% to 20% low density polyethylene, 0% to 10% color concentrate, 0% to 15% calcium fillers, 0% to 20% post-consumer resin and 0% to 4% other additives.

6. The secure food transport bag, as described in claim 1, wherein said flexible film material comprises 0%-100% corn based products.

7. A secure food transport bag comprising:

a front wall and a back wall, said front and back walls being formed of flexible film material and having top and bottom edges and first and second side edges;

said front wall having a folded portion, said folded portion having an upper edge, said upper edge being parallel to said top edge, said folded portion extending downwardly from said top edge for a first predetermined distance;

said front and back walls being joined together along their first and second side edges at first and second side seams, said first and second side seams securing first and second distal ends of said folded portion to an outer surface of said front wall, and along their bottom edges at a bottom seam to form a bag with an open mouth;

said folded portion being sealed to said outer surface of said front wall with first and second vertical seals, said first and second vertical seals being spaced from a center point of said folded portion to form a handle opening;

a tamper-proof adhesive compound, said compound being affixed to an interior surface portion of said back wall adjacent said top edge and extending from said first side edge to said second side edge;

said tamper-proof adhesive being removable from said flexible film material only with force sufficient to tear said material;

a removable protective strip, said protective strip being adhered to said tamper-proof adhesive to prevent its attachment to said flexible film material until closing of said bag;

wherein after placing a food item into said bag, said protective strip is removed from said interior surface portion of said back wall and said interior surface portion is folded downwardly and pressed to an outer surface of said folded portion of said front wall, thereby sealing the bag with the food item inside with a tamper-proof seal.

8. The secure food transport bag, as described in claim 7, further comprising first and second angled seals, said first and second angled seals extending from said first and second vertical seals upwardly at an angle toward said upper edge of said folded portion, thereby forming a contoured shape for said handle opening.

9. The secure food transport bag, as described in claim 7, further comprising a bottom gusset, said bottom gusset being folded inwardly from said bottom seam and sealed to said first and second side edges in said first and second side seams.

10. The secure food transport bag, as described in claim 7, wherein said tamper-proof adhesive compound is a pressure sensitive adhesive comprising 0%-100% rosin ester and an elastomer selected from the group comprising acrylics, bio-based acrylate, butyl rubber, ethylene-vinyl acetate, natural rubber, nitriles, and silicone rubbers.

11. The secure food transport bag, as described in claim 7, wherein said flexible film material comprises 25% to 75% high density high molecular weight polyethylene resin, 20% to 75% linear low polyethylene resin, 0% to 20% low density polyethylene, 0% to 10% color concentrate, 0% to 15% calcium fillers, 0% to 20% post-consumer resin and 0% to 4% other additives.

12. The secure food transport bag, as described in claim 7, wherein said flexible film material comprises 0%-100% corn based products.

* * * * *